US007901128B2

(12) United States Patent
Gehrke et al.

(10) Patent No.: US 7,901,128 B2
(45) Date of Patent: Mar. 8, 2011

(54) TAPERED APERTURE MULTI-TEE MIXER

(75) Inventors: Joerg-Peter Gehrke, Stade (DE); Paul A. Gillis, Lake Jackson, TX (US); Hua Bai, Lake Jackson, TX (US)

(73) Assignee: Dow Global Technologies LLC, Midland, MI (US)

( * ) Notice: Subject to any disclaimer, the term of this patent is extended or adjusted under 35 U.S.C. 154(b) by 1020 days.

(21) Appl. No.: 11/658,193

(22) PCT Filed: Jul. 7, 2005

(86) PCT No.: PCT/US2005/024284

§ 371 (c)(1),
(2), (4) Date: Jan. 22, 2007

(87) PCT Pub. No.: WO2006/019619

PCT Pub. Date: Feb. 23, 2006

(65) Prior Publication Data

US 2008/0087348 A1 Apr. 17, 2008

Related U.S. Application Data

(60) Provisional application No. 60/589,367, filed on Jul. 20, 2004.

(51) Int. Cl.
*B01F 5/04* (2006.01)

(52) U.S. Cl. ..... 366/162.4; 366/173.1

(58) Field of Classification Search ..... 366/173.1, 366/173.2, 181.6, 162.4, 165.1, 165.4, 165.2, 366/167.1

See application file for complete search history.

(56) References Cited

U.S. PATENT DOCUMENTS

| | | | | | |
|---|---|---|---|---|---|
| 145,538 | A | * | 12/1873 | Stoddart | 261/124 |
| 2,307,509 | A | * | 1/1943 | Joachim et al. | 366/178.2 |
| 3,226,410 | A | | 12/1965 | Hettich et al. | |
| 3,332,442 | A | | 7/1967 | Reed | |
| 3,351,635 | A | | 11/1967 | Kollar | |
| 3,459,810 | A | | 8/1969 | Choo et al. | |
| 3,984,504 | A | * | 10/1976 | Pick | 261/76 |
| 4,053,142 | A | * | 10/1977 | Johannes | 366/165.1 |
| 4,066,706 | A | | 1/1978 | Schmidt | |
| 4,123,800 | A | * | 10/1978 | Mazzei | 366/163.2 |
| 4,128,587 | A | | 12/1978 | Jubin | |
| 4,289,732 | A | * | 9/1981 | Bauer et al. | 422/224 |
| 4,474,477 | A | * | 10/1984 | Smith et al. | 366/165.5 |
| 4,625,916 | A | * | 12/1986 | Nieuwkamp et al. | 239/431 |
| 4,656,001 | A | * | 4/1987 | Roger et al. | 376/405 |
| 4,737,573 | A | | 4/1988 | Silva et al. | |
| 4,761,077 | A | | 8/1988 | Werner | |
| 4,939,230 | A | | 7/1990 | Munjal et al. | |
| 5,117,048 | A | | 5/1992 | Zaby et al. | |
| 5,435,913 | A | * | 7/1995 | Ashbrook | 210/188 |
| 5,486,627 | A | | 1/1996 | Quarderer et al. | |

(Continued)

FOREIGN PATENT DOCUMENTS

EP 0402567 12/1990

(Continued)

*Primary Examiner* — Tony G Soohoo

(57) ABSTRACT

An apparatus and a method for mixing at least two fluid substances and carrying out or initiating a reaction between them, wherein the apparatus is a static mixer are described. The static mixer includes a fluid receiving chamber, a first conduit passing through the fluid receiving chamber and having at least one tapered aperture therethrough, and a second conduit operatively connected to the fluid receiving chamber.

19 Claims, 4 Drawing Sheets

U.S. PATENT DOCUMENTS

| | | | | |
|---|---|---|---|---|
| 5,532,389 | A | 7/1996 | Trent et al. | |
| 5,845,993 | A | 12/1998 | Shirtum et al. | |
| 5,931,579 | A | 8/1999 | Gallus et al. | |
| 6,012,492 | A * | 1/2000 | Kozyuk | 138/37 |
| 6,017,022 | A | 1/2000 | Shirtum | |
| 6,767,007 | B2 * | 7/2004 | Luman | 261/76 |
| 2004/0008572 | A1 | 1/2004 | Stuart | |
| 2008/0087348 | A1 * | 4/2008 | Gillis et al. | 137/896 |

FOREIGN PATENT DOCUMENTS

| | | |
|---|---|---|
| WO | WO-98/57906 | 12/1998 |

* cited by examiner

TAPERED APERTURE MULTI-TEE MIXER

CROSS REFERENCE TO RELATED APPLICATIONS

This application is a 35 U.S.C. Section 371 of PCT/US2005/024284 filed Jul. 7, 2005, which claims priority to previously filed U.S. Provisional Patent Application Ser. No. 60/589,367 filed Jul. 20, 2004, both of which are incorporated by reference herein in their entirety.

FIELD OF THE INVENTION

This invention relates generally to mixing fluid components and an apparatus for carrying out the mixing, and more particularly relates to an improved apparatus for mixing fluid components in processes where rapid and thorough mixing without undesirable back mixing is beneficial.

BACKGROUND OF THE INVENTION

The field of conventional mixing devices can be roughly divided into two main areas: mechanical mixers and static mixers. Mechanical mixers rely on some type of moving part or parts to impart energy into the fluid components being mixed. Static mixers generally have no prominent moving parts, and instead rely on the pressure drop of one or more of the fluids to serve as the source of mixing energy. Conventional mixer tees are a type of static mixer.

Multi-tee mixers having a tee-pipe junction and a straight pipe section with nozzles and blind flanges are usefully employed for rapidly initiated reactions The junction contains a mixing chamber having separate inlets for at least two substances and an outlet. Typically, the inlet for one of the substances is provided within the axis of the mixing chamber and the inlet for the other substance or substances is constructed in the form of a plurality of nozzles or jets arranged rotationally symmetrical to the axis along the circumference of the mixing chamber.

The quality of the products prepared in an apparatus of this type depends on the quality and rate of mixing of the fluid substances. The quality and rate of mixing can be affected by fouling, caking, or plugging of the jets of the inlet of the mixer tee and results in decreased performance. Over the course of time, caking and subsequent clogging disturbs the injection and the distribution of flow through the jets. The risk of clogging increases where the substance that passes through the nozzles is dissolved or suspended in a solvent or in a suspending medium and the solvent or suspending medium is separated from the product and reused. Caking may also occur on the mixer-side surfaces of the jet as a result of secondary reactions. Where caking and/or clogging occur, a continuous process has to be interrupted and the tee mixers taken apart and cleaned. This causes undesirable idle periods. Where hazardous substances are used, industrial hygiene regulations necessitate expensive measures during the disassembly of the tee mixers, such as the thorough flushing of the system before disassembly, exhaustion of the atmosphere, protective clothing, and breathing apparatuses for the worker. Each of these measures adds to the overall cost, reduces throughput, and reduces the efficiency of the process.

Some chemical reactions require rapid mixing with minimal back mixing. Back mixing can allow a product of an initial reaction to react with another component in the reaction stream to generate an undesired product. Back mixing can contribute to by-product formation and mixer fouling. Consequently, mixer designs that do not account for back mixing issues can result in lower overall yield of the desired product or can generate a product that clogs or fouls the reactor system leading to down time and/or increased maintenance costs.

Therefore, there is a need for a mixing device that provides rapid mixing of reactants, yet provides a reaction system that does not suffer from unacceptable fouling, particularly of the jets of the mixer-tee.

BRIEF SUMMARY OF THE INVENTION

Embodiments of the invention provide a shear mixing apparatus that includes a fluid receiving chamber, at least one first conduit passing through the fluid receiving chamber and having at least one tapered aperture therethrough, and a second conduit operatively connected to the fluid receiving chamber. Some embodiments further comprise a secondary barrier having orifices therethrough and wherein the secondary barrier surrounds the first conduit. Some of the orifices of the secondary barrier have a smaller diameter than the diameter of the tapered apertures at the outer surface of the first conduit. In particular embodiments, the secondary barrier comprises a pipe.

Some embodiments include a plurality of first conduits that pass through the receiving chamber wherein each conduit has at least one tapered aperture therethrough and is operatively connected to the fluid receiving chamber. Preferably, the opening of the aperture on the outer surface of the first conduit is larger than the opening of the aperture on the inner surface of the conduit. Thus, the aperture in the first conduit has a taper wherein a cross-section of the aperture shows that the aperture has a sidewall that on the macroscopic scale forms at least one angle ranging from greater than 0 degrees to less than 90 degrees. In some embodiments, the taper of the apertures has at least one angle ranging from about 5 degrees to less than 60 degrees. In other embodiments, the taper of the apertures has at least one angle ranging from greater than 10 degrees to less than 30 degrees. Preferred embodiments have one or more apertures where the taper of the apertures has at least one angle ranging from greater than 10 degrees to less than 20 degrees. In some embodiments, the angle of the taper is determined with respect to a plane perpendicular to the surface of the first conduit. In embodiments where the aperture does not have an axis of symmetry perpendicular to the surface of the first conduit, the angle can be determined with respect to the central axis of the aperture.

In some embodiments, the one or more apertures of the first conduit include a single taper angle. In other embodiments, the aperture has two or more taper angles. In still other embodiments, an axis of the aperture forms an angle ranging from greater than 0 degrees to less than 90 degrees with respect to the surface of the first conduit. Of course the first conduit can include a plurality of tapered apertures therethrough in any desirable configuration. In one such configuration the first conduit includes a plurality of tapered apertures that are contained in a plane having a thickness equal to the largest dimension or diameter of the aperture openings. In some embodiments, the plane that contains the apertures is perpendicular to the central axis of the first conduit. In one embodiment, the first conduit includes a plurality of such rows of such tapered apertures. The number of apertures, size, and spacing of tapered apertures provide rapid mixing of the fluids without excessive pressure loss across the aperture.

In another aspect, embodiments of the invention provide a method of mixing that includes passing a first fluid through at least one first conduit having at least one tapered aperture therein, passing a second fluid into the first conduit through the at least one tapered aperture and allowing the first and second fluids to mix in the first conduit. Some embodiments further include passing the second fluid through a secondary barrier having orifices therethrough. In some embodiments, the secondary barrier surrounds the first conduit to form a secondary enclosure. In particular embodiments, the orifices of the secondary barrier have a smaller diameter than the diameter of the tapered apertures at the outer surface of the first conduit. In some preferred embodiments, the secondary barrier comprises a pipe.

In other embodiments, the method includes passing a first fluid through a plurality of first conduits that pass through the receiving chamber, each conduit having at least one tapered aperture therethrough, and being operatively connected to the fluid receiving chamber. Preferably, the opening of the aperture on the outer surface of the first conduit is larger than the opening of the aperture on the inner surface of the conduit. Thus, the method uses a conduit with an aperture therein that has a taper. In other words, a cross-section of the aperture shows that the aperture has a sidewall that on the macroscopic scale forms at least one angle ranging from greater than 0 degrees to less than 90 degrees. In some embodiments of the method, the taper of the apertures has at least one angle ranging from about 5 degrees to less than 60 degrees. In other embodiments, the taper of the apertures has at least one angle ranging from greater than 10 degrees to less than 30 degrees. Preferred embodiments have one or more apertures where the taper of the apertures has at least one angle ranging from greater than 10 degrees to less than 20 degrees. In some embodiments, the angle of the taper is determined with respect to a plane perpendicular to the surface of the first conduit. In embodiments where the aperture does not have an axis of symmetry perpendicular to the surface of the first conduit, the angle can be determined with respect to the central axis of the aperture.

In some methods, the one or more apertures of the first conduit include a single taper angle. In other embodiments, the aperture has two or more taper angles. In still other embodiments of the methods described herein, an axis of the aperture forms an angle ranging from greater than 0 degrees to less than 90 degrees with respect to the surface of the first conduit. Of course the first conduit can include a plurality of tapered apertures therethrough in any desirable configuration. In one such configuration, the first conduit includes a plurality of tapered apertures that are contained in a plane having a thickness equal to the largest dimension or diameter of the aperture openings. In some embodiments, the plane that contains the apertures is perpendicular to the central axis of the first conduit. In one embodiment, the first conduit includes a plurality of such rows of such tapered apertures. The number of apertures, size, and spacing of tapered apertures provide rapid mixing of the fluids without excessive pressure loss across the aperture.

DETAILED DESCRIPTION OF THE INVENTION

In the following description, all numbers disclosed herein are approximate values, regardless whether the word "about" or "approximate" is used in connection therewith. They may vary by 1 percent, 2 percent, 5 percent, or, sometimes, 10 to 20 percent. Whenever a numerical range with a lower limit, RL and an upper limit, RU, is disclosed, any number falling within the range is specifically disclosed. In particular, the following numbers within the range are specifically disclosed: R=RL+k*(RU-RL), wherein k is a variable ranging from 0 percent, 1 percent to 100 percent with a 1 percent increment, i.e., k is 0 percent, 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

Embodiments of the invention provide an apparatus for mixing fluids comprising a fluid receiving chamber, a first conduit passing through the fluid receiving chamber, where the conduit has at least one tapered aperture, and a second conduit operatively connected to the fluid receiving body.

Figure 1:
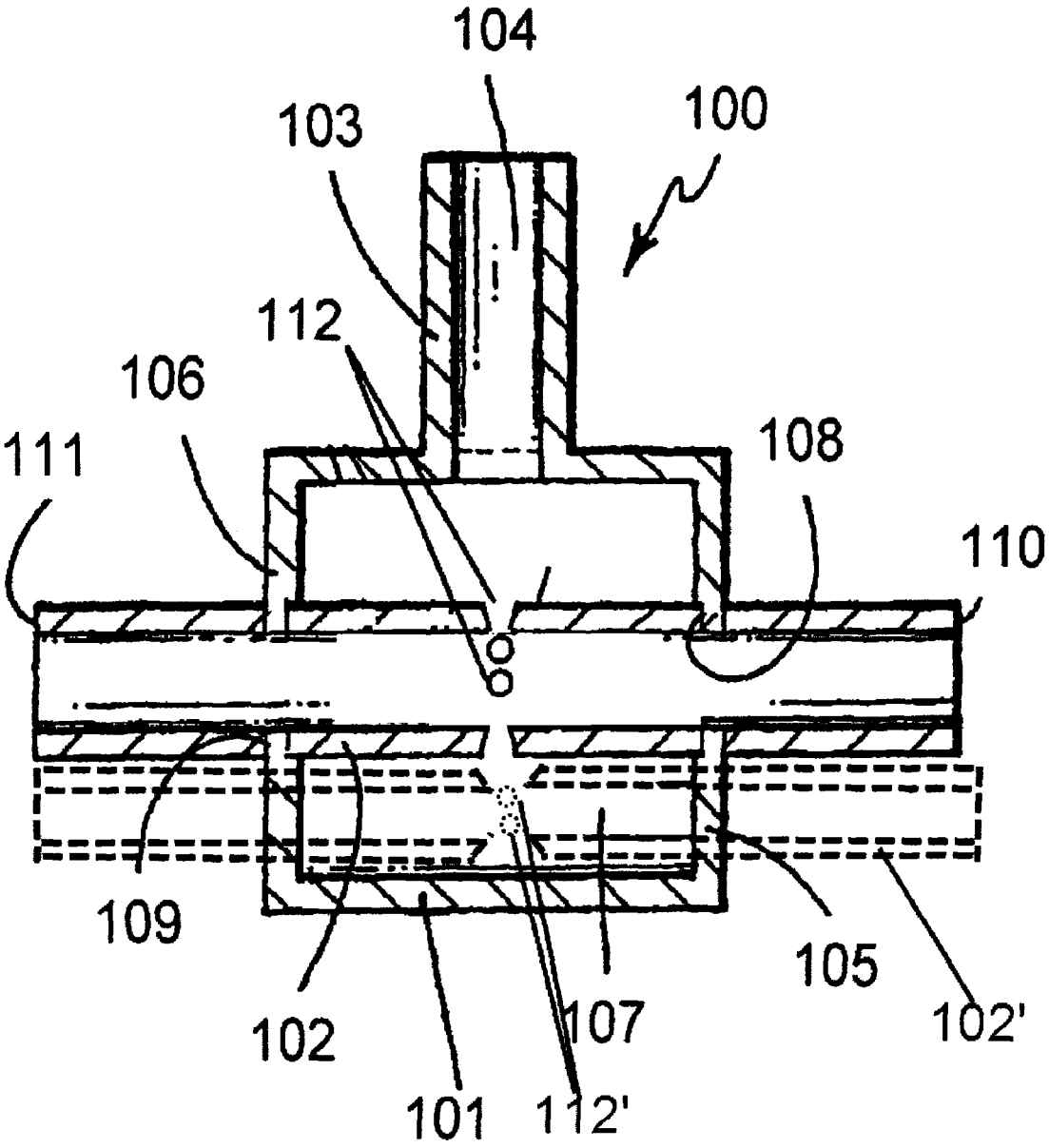
FIG. 1 is an axial schematic sectional view of a shear mixing apparatus according to one embodiment of the invention.

Turning now to FIG. 1, a mixing apparatus 100 is schematically illustrated according to one embodiment of the invention. Apparatus 100 comprises a fluid receiving chamber 101, an aperture-bearing conduit 102, and a fluid supply conduit 103 that contains passageway 104.

Chamber 101 has a first end 105 and a second end 106 that is distant from first end 105. Chamber 101 encloses a volume 107 between the ends 105 and 106 thereby providing a space for the distribution of the fluid entering the tapered apertures. First end 105 has defined therein an aperture 108 that is preferably coaxially aligned with aperture 109 in the second end 106. In embodiments having more than one aperture 108, each aperture 108 is preferably coaxial with an opposing aperture 109. A suitable shape for chamber 101 (ignoring fluid supply conduit 103 for purposes of visualization) is a hollow right circular cylinder that is closed at both ends save for apertures 108 and 109.

Conduit 102 has a first end 110 and a second end 111 that is distant from first end 110. The conduit 102 passes through, and is fitted within apertures 108 and 109 of chamber 101. Fitting of the conduit 102 within apertures 108 and 109 is preferably accomplished in such a manner as to provide a leak-proof, preferably gas-tight, seal about the conduit 102 where it passes through apertures 108 and 109. The conduit 102 may be a single pipe or may be formed of sections of different pipes and materials so long as a passageway capable of communicating a fluid therethrough is provided. Because first end 105 and second end 106 are spaced apart from each other, chamber 101 thereby encloses a length of the conduit 102. Within the length of the conduit enclosed by ends 105 and 106, conduit 102 has defined therein at least one tapered aperture 112. Each tapered aperture 112 allows fluid communication between the conduit 102 and enclosed volume 107. In some embodiments, the conduit 102 has a plurality of tapered apertures 112. In a preferred embodiment, the tapered apertures 112 are in a single plane perpendicular to the center axis of the conduit 102. In an alternate embodiment, there are multiple rows of tapered apertures 112. The number, size, spacing and location of the tapered apertures 112 are sufficient to provide rapid mixing of the fluids without excessive pressure loss across the aperture. Some embodiments include a plurality of first conduits (102, 102') that pass through the receiving chamber 101 wherein each conduit has at least one tapered aperture (112, 112') therethrough and is operatively connected to the fluid receiving chamber 101.

Fluid supply conduit 103 is operatively connected to chamber 101 at a point intermediate between first end 105 and second end 106 of chamber 101. When so connected, passageway 104 of conduit 103 is in fluid communication with enclosed volume 107. If desired, one or more additional fluid supply conduits may be operatively connected to chamber 101 in a like manner, for supplying additional fluids to the chamber 101. The combination of the fluid supply conduit 103 and enclosed volume 107 comprise a simple piping tee.

Apparatus 100, shown in FIG. 1, suitably combines a first motive fluid, desirably a liquid, that flows through aperture-bearing conduit 102 with a second motive fluid, desirably a second liquid, that flows through passageway 104 of fluid supply conduit 103. The first motive fluid flows into the conduit 102 by way of an operative connection with a source (not shown). With no change in cross-sectional area, there is substantially no variation in fluid velocity as the first motive fluid flows through conduit 102. The second motive fluid flows into passageway 104 from a source (not shown) by way of an operative connection with fluid supply conduit 103. The second motive fluid flows from passageway 104 into enclosed volume 107 and, from there, via apertures 112 into conduit 102. The second motive fluid is under a pressure to substantially preclude entry of the first motive fluid into enclosed volume 107. The second motive fluid is mixed with the first motive fluid within the apertured conduit 102. The mixture flows out of the apertured conduit 102 via the second end 106.

Figure 2:
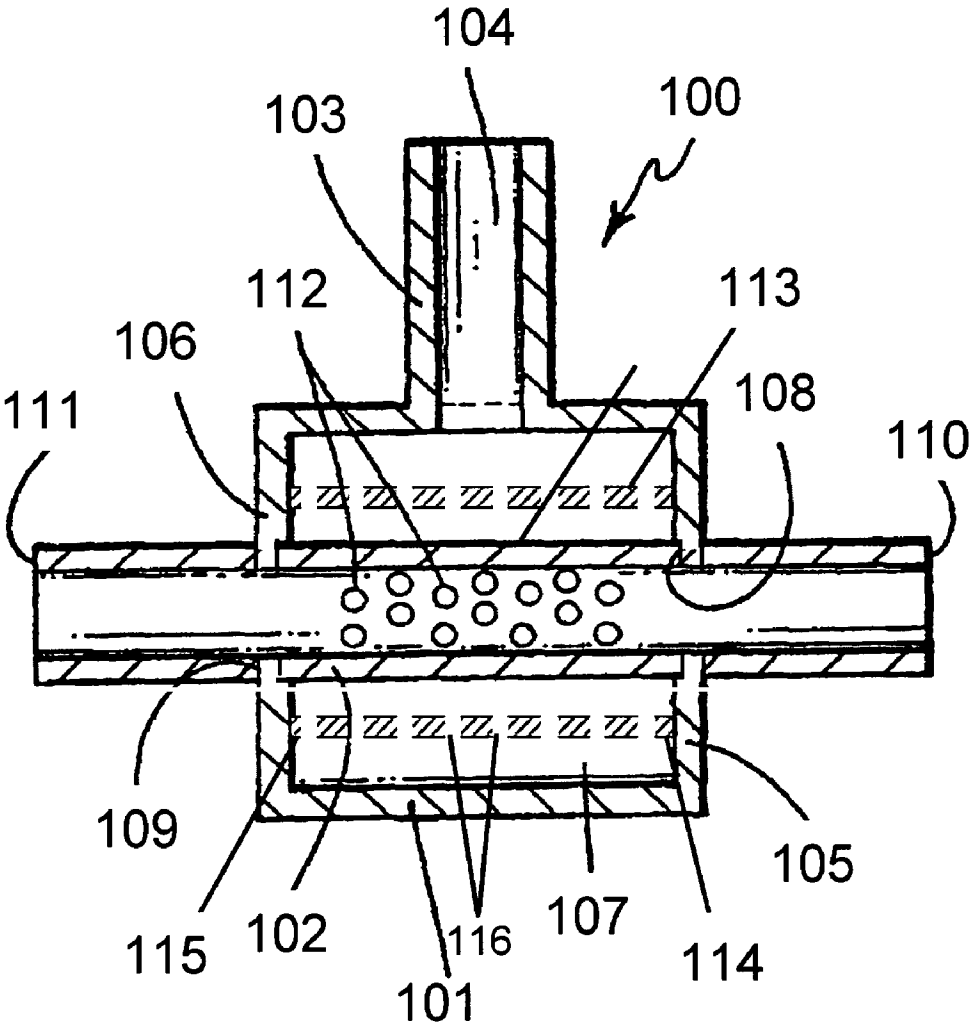
FIG. 2 is an axial schematic sectional view of a shear mixing apparatus according to another embodiment of the invention

Referring to FIG. 2 with continuing reference to FIG. 1, an alternative embodiment of the apparatus 100 that further includes a perforated secondary barrier 113 is described. The perforated barrier 113 has a first end 114 and a second end 115 that is distant from the first end 114. Because first end 114 and second end 115 are spaced apart from each other, the perforated barrier thereby encloses a length of the conduit 102. Within the enclosed length, the perforated barrier 113 has defined therein a plurality of apertures 116. Each aperture 116 is in fluid communication with enclosed volume 107. The number, size, spacing and location of apertures 116 are sufficient to act as a screen or filter to prevent solids from entering the tapered apertures 112. Preferably, the diameter of the apertures 116 are smaller than the diameter of the tapered apertures 112 on the outer surface of the conduit 102. Furthermore, the total cross-sectional area of the apertures 116 should be large enough so that the pressure drop across the apertures 116 is negligible. In a preferred embodiment, the secondary barrier 113 forms an enclosed around a length of the conduit 102. One way of providing such an enclosure is to provide a length of perforated pipe as the secondary barrier 113.

Figure 3A:
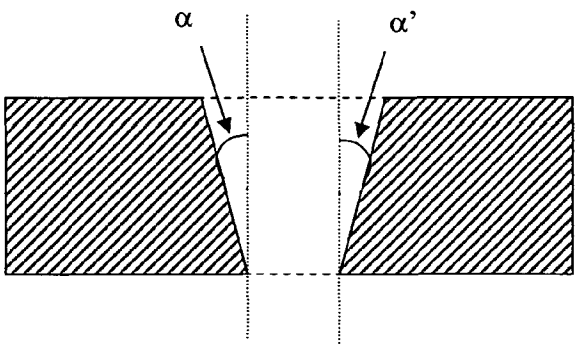
FIG. 3 is a schematic sectional view of a simple taper port.
Figure 3B:
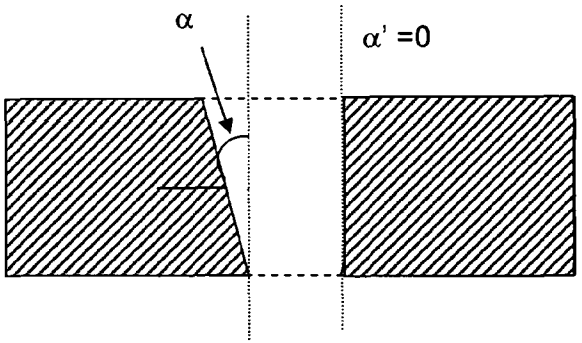

Regardless of the embodiment used, the apertures 112 are tapered. In other words, the opening of the aperture 112 on the outer surface of the conduit 102 is a different size than the opening on the inner surface of the conduit 102. As illustrated in FIG. 3, some embodiments of the invention use a taper of the side walls of the aperture 112 that is a single taper. The term "single taper" as used herein refers to tapers that have angles $\alpha$ and $\alpha'$ with respect to the plane perpendicular to the surface of the conduit 102. The taper of the apertures 112 can have any desirable angle with respect to the plane perpendicular to the surface of the conduit 102. The angles $\alpha$ and $\alpha'$ may independently vary from 0 degrees to 90 degrees, provided they are not both zero degrees. Thus, in some embodiments, the tapered aperture may have an angle $\alpha$ or $\alpha'$ that is greater than 0 degrees to about 90 degrees. In some embodiments, the angles $\alpha$ and $\alpha'$ are determined with respect to the central axis of the aperture rather than a plane perpendicular to the conduit 102. In particular embodiments, the angles $\alpha$ and $\alpha'$ are greater than 0 degrees and less than 90 degrees. In some embodiments, the lower limit of the range of angles for $\alpha$ and $\alpha'$ of the apertures 112 is from about 5 degrees, 10 degrees, 15 degrees, 20 degrees, 25 degrees, 30 degrees, 35 degrees, 40 degrees, 45 degrees, 50 degrees, or 55 degrees with respect to the plane perpendicular to the surface of the conduit 102. The upper limit of the range of suitable angles for the angles for $\alpha$ and $\alpha'$ of the apertures 112 may be 5 degrees, 10 degrees, 15 degrees, 20 degrees, 25 degrees, 30 degrees, 35 degrees, 40 degrees, 45 degrees, 50 degrees, 55 degrees, 60 degrees, 75 degrees, or 85 degrees depending on the desired flow characteristics and other design parameters. Typical lower limits for $\alpha$ and $\alpha'$ are about 5 degrees, 10 degrees or 15 degrees. Angles from about 45 degrees to 60 degrees are typical upper limits. In a preferred embodiment, the angles $\alpha$ and $\alpha'$ are from about 10 degrees to about 30 degrees. In one embodiment, the angles $\alpha$ and $\alpha'$ are about 10 to 15 degrees. Consequently, the taper generally provides an aperture that is wider on the outer surface of the conduit 102 than it is on the inner surface of the conduit 102. However, in some embodiments, the opposite may be true. In other words the taper can be formed to provide an aperture whose opening on the outer surface of the conduit 102 is narrower than the opening of the aperture on the inner surface of the conduit 102.

Figure 4A:
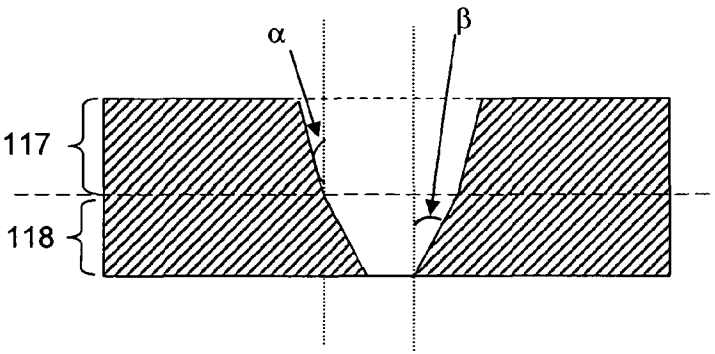
FIG. 4 is a schematic sectional view of a multiple taper port.
Figure 4B:
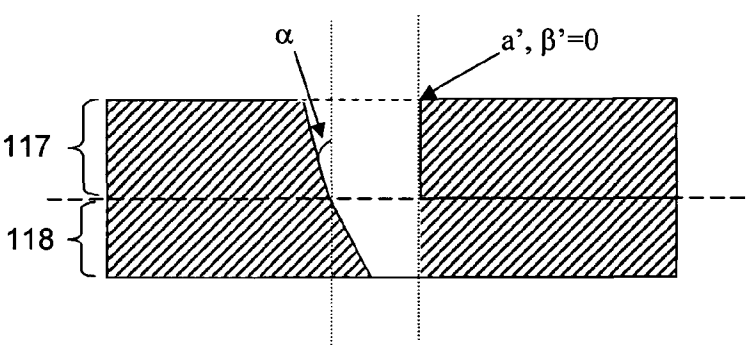

As shown in FIG. 4, in other embodiments, the tapered apertures 112 have more than one angle with respect to the plane perpendicular to the surface of the conduit 102. Thus, in some embodiments, the aperture may have an upper section 117 with angles $\alpha$ and $\alpha'$ that may take the angles described above and a lower section 118 where the sidewalls of the aperture have angles $\beta$ and $\beta'$ that range from 0 degrees to less than 90 degrees. In such embodiments, the lower limit on the range of values for angles $\alpha$ and $\alpha'$ is 0 degrees, 5 degrees, 10 degrees, 15 degrees, 20 degrees, 25 degrees, or 30 degrees, 35 degrees, 40 degrees, 45 degrees, 50 degrees or 55 degrees. The upper limit on the range of suitable angles $\alpha$ and $\alpha'$ for the taper of the apertures 112 in embodiments having more than one taper angle may be 30 degrees, 35 degrees, 40 degrees, 45 degrees, 50, degrees, 55 degrees, 60 degrees, 75 degrees, or about 85 degrees depending on the desired flow characteristics and other design parameters. Angles ranging from about 5 degrees as a lower limit to about 45 to 60 degrees as an upper limit range are typical. In a preferred embodiment, the angle is from about 10 to about 30 degrees. In other embodiments, the angles $\alpha$ and $\alpha'$ range from about 10 to about 15 degrees. The lower limit on the range of values for angles $\beta$ and $\beta'$ may be 0 degrees, 5 degrees, 10 degrees, 15 degrees, 20 degrees, 25 degrees or 30 degrees, 35 degrees, 40 degrees, 45 degrees, 50 degrees, 55 degrees or about 60 degrees, determined in the same manner as the angles $\alpha$ and $\alpha'$. The upper limit on the range of suitable angles $\beta$ and $\beta'$ for the taper of the apertures 112 in embodiments having more than one taper angle may be 30 degrees, 35 degrees, 40 degrees, 45 degrees, 50, degrees, 55 degrees, 60 degrees, 75 degrees, or about 85 degrees. In embodiments with multiple tapers, $\alpha$ and $\alpha'$ range typically from 0 degrees to about 20 degrees while $\beta$ and $\beta'$ typically range from about 10 to about 60 degrees. In one embodiment, the angle $\alpha$ is 0 degrees and the angle $\beta$ is about 45 degrees. In some embodiments, $\alpha'$ and $\beta'$ are 0 degrees. Some embodiments include an aperture 112 with three or more different angles where each angle is greater than 0 degrees and less than 90 degrees. In preferred embodiments, the selection of angles provides an aperture wherein the opening on the outer surface of the conduit 102 is wider than the width of the aperture at any point in the interior of the aperture 112 and the opening inner surface of the conduit 102 is narrower than any point on the interior of the aperture 112.

Figure 5:
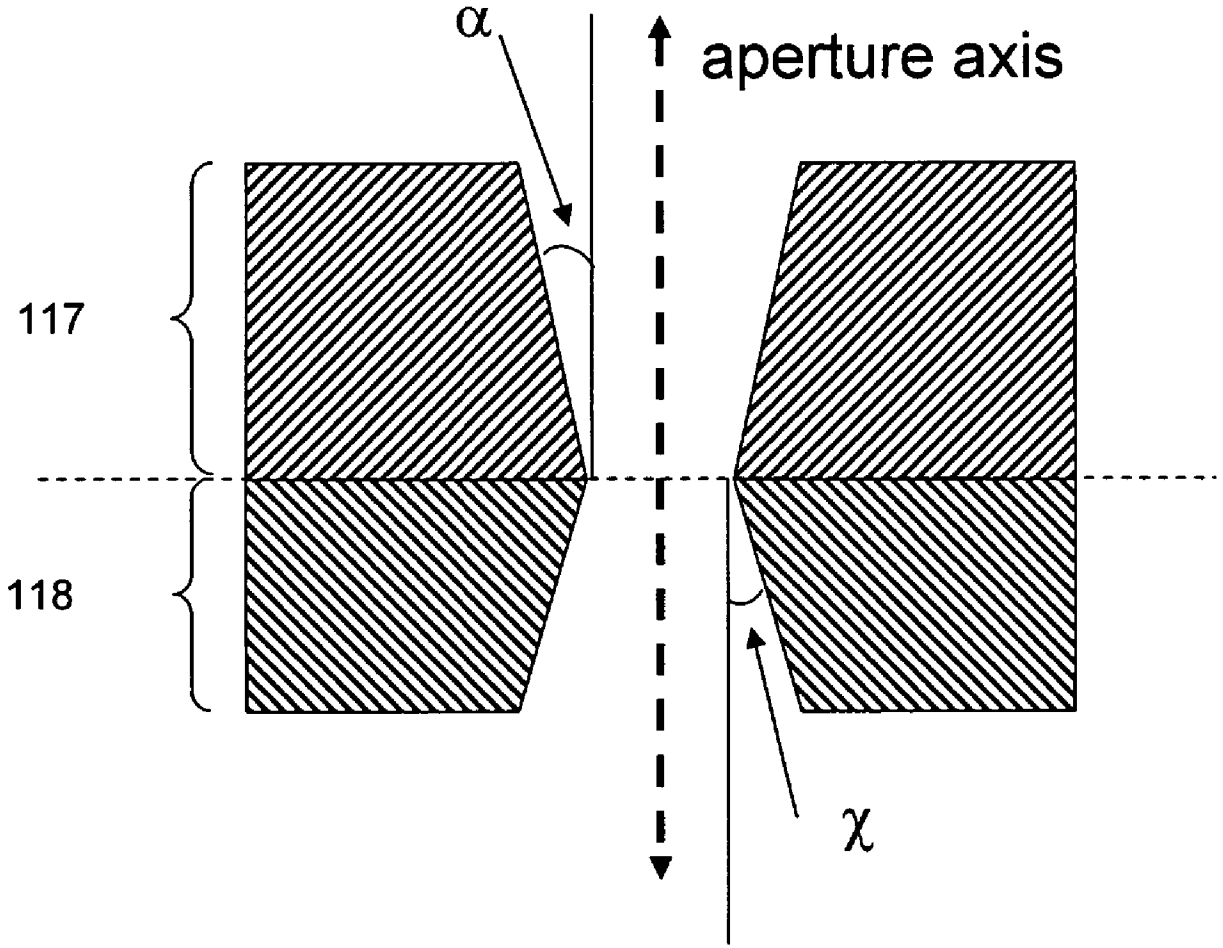
FIG. 5 is a schematic sectional view of an alternative configuration of a multiple taper aperture.

In other embodiments, as shown in FIG. 5, the tapered apertures 112 could be oriented to both contract or expand. Thus, in some embodiments, the aperture may have an upper section 117 with an angle $\alpha$ ranging from greater than 0 degrees to less than 90 degrees and a lower section 118 where the sidewalls of the aperture have an angle $\chi$ that ranges from greater than 0 degrees to less than 90 degrees. The lower limit on the range of values for angle $\alpha$ is 0 degrees, 5 degrees, 10 degrees, 15 degrees, 20 degrees, 25 degrees, or 30 degrees with respect to the plane perpendicular to the surface of the conduit 102. The upper limit on the range of suitable angles, $\alpha$, for the taper of the apertures 112 in embodiments having more than one taper angle may be 30 degrees, 35 degrees, 40 degrees, 45 degrees, 50, degrees, 55 degrees, 60 degrees, 75 degrees, or about 85 degrees depending on the desired flow characteristics and other design parameters. Angles ranging from about 5 to about 45 degrees are typical. In a preferred embodiment, the angle $\alpha$ is from about 10 degrees to about 30 degrees. The lower limit on the range of values for angle $\chi$ may be 0 degrees, 5 degrees, 10 degrees, 15 degrees, 20 degrees, 25 degrees, or 30 degrees with respect to the plane perpendicular to the surface of the conduit 102. The upper limit on the range of suitable angles, $\chi$, for the taper of the apertures 112 in embodiments having more than one taper angle may be 30 degrees, 35 degrees, 40 degrees, 45 degrees, 50, degrees, 55 degrees, 60 degrees, 75 degrees, or about 85 degrees. FIG. 5 also denotes the aperture axis which is defined as the central axis about which the aperture is located. The aperture axis (axes for multiple apertures) is drawn perpendicular to the conduit surface, but this axis can be oriented at various angles with respect to the conduit surface. This angle can range from greater than 0 degrees to less than 90 degrees with a preferred angle of between 5 and 45 degrees.

Whether the tapered aperture 112 has a single taper or multiple tapers, the tapered aperture 112 should be selected to prevent or inhibit fluid in the cross-flow stream in conduit 102 from entering or fouling the aperture 112. The tapering also reduces the pressure losses across the tapered aperture 112. The taper of the aperture 112 constricts the flow into the conduit and allows the flow to penetrate the cross-flow further, providing faster mixing. The taper of the aperture 112 also inhibits reverse flow in the aperture.

Embodiments of apparatuses within the scope of the present invention, such as those depicted in FIG. 1, are useful in a wide variety of applications. The embodiments of the present invention are preferably used with highly reactive components. The fluids may either be liquids or gases or combinations thereof. Tapered apertures 112 described herein can be incorporated into any tee-mixer design or process where fouling and cross-flow management are desired. For example, the apertures of the mixers described in U.S. Pat. Nos. 3,226,410; 3,332,442; 5,845,993; and 6,017,022, each of which is incorporated by reference in its entirety for purposes of U.S. patent practice, may benefit from tapered apertures of the type described herein.

Other illustrative, non-limiting uses include improving mass transfer of oxygen or air into water used in bioreactors that treat waste water streams, improving the performance of oxygen-activated polymerization inhibitors in one or more stages of a polymerization reaction and generally, improving the miscibility of at least one gas in a liquid. An example of a commercially-significant use of the mixing apparatus of the present invention in this last regard, would be in the production of polycarbonates in a solution process or in an interfacial process particularly, wherein a gaseous carbonic acid derivative such as phosgene is reacted with a dihydroxy compound such as the aromatic dihydroxy compound 2,2-bis(4-hydroxyphenyl)propane (commonly, "Bisphenol-A") in a homogeneous solution containing the Bisphenol-A and phosgene (the solution process), or in a two-phase system wherein the Bisphenol-A is dissolved or suspended in an aqueous solution of an organic base and an organic solvent (methylene chloride, for example) which is capable of dissolving the polycarbonate oligomer product of the reaction of phosgene and Bisphenol-A is also present (the interfacial process). Various batchwise and continuous processes and arrangements of unit operations, involving both plug-flow and continuous stirred tank reactors, have been described in the art or are known, see, for example, U.S. Pat. Nos. 4,737,573 and 4,939,230 and the various references cited therein. Those skilled in the polycarbonate art will appreciate that embodiments of the shear mixing apparatus of the present invention may be appropriately and desirably used in many of these processes for improving the flow regimes established therein, and with regard to those known interfacial processes wherein phosgene is bubbled into the process with the methylene chloride organic solvent, for example, will beneficially improve the dispersion of the phosgene into the methylene chloride.

In another general aspect, it will be apparent to those skilled in the art that embodiments of the present invention in both its apparatus and method aspects may be useful in reducing the reaction time, and thus in reducing either the number or size of reaction vessels required to produce a predetermined amount of a product (correspondingly reducing the cost to make the product) or in potentially enabling additional product to be made from existing reactors and processes, for any kinetically fast-reacting gas-liquid reactive system that is mass-transfer limited. Many oxidation and hydrogenation processes fall into this category, as will be readily appreciated.

For example, the oxidation processes to produce ethylbenzene hydroperoxide and t-butyl hydroperoxide, which are intermediates in known commercial processes for respectively co-producing propylene oxide and styrene on the one hand and propylene oxide and tert-butyl alcohol on the other, involve significant reaction times (on the order of from 1 to 4 hours, see "Propylene Oxide", Kirk-Othmer Encyclopedia of Chemical Technology, 3.sup.rd Edition, vol. 19, pp. 257-261 (1982)) and may require multiple reactor vessels. In this regard, t-butyl hydroperoxide conventionally is prepared via the liquid phase air oxidation of isobutane in the presence of from 10-30 percent of tertbutyl alcohol, at a temperature of from 95 to 150 degrees Celsius and a pressure of from 2075 to 5535 kPa, in a conversion of 20 to 30 percent of the isobutane and a selectivity to TBHP of 60 to 80 percent and to TBA of 20 to 40 percent. Unreacted isobutane and a portion of the TBA produced are separated from the product stream and recycled back to the hydroperoxide forming reactor, see also U.S. Pat. No. 4,128,587. Ethylbenzene hydroperoxide also is prepared by a liquid phase oxidation, in this case of ethylbenzene by air or oxygen at 140 to 150 degrees Celsius and 30 to 30 psia (206-275 kPa, absolute). Conversion to the hydroperoxide is reported to be 10 to 15 percent over a reaction time of from 2 to 2.5 hours. Relevant hydroperozide processes are also described in U.S. Pat. Nos. 3,351,635; 3,459,810; and 4,066,706; incorporated herein by reference in their entirety for the purposes of US. patent practices.

Yet another commercially significant application concerns the manufacture of epoxides via the corresponding olefin chlorohydrins, for example, epichlorohydrin from allyl chloride, butylene oxide via butylene chlorohydrin and propylene oxide via propylene chlorohydrin. Thus, in a broad sense, embodiments of the present invention enables a more effective process for making epoxides, or, as just mentioned above, still more broadly facilitate other two phase, gas-liquid reactive processes where some benefit may be gained by improving the mass transfer of the gas into the liquid.

With particular regard for the production of epoxides via an olefin chlorohydrin intermediate, conventionally this is accomplished by formation of the olefin chlorohydrin and thereafter contacting the chlorohydrin with an aqueous alkali metal hydroxide in an epoxidation step, to form an aqueous salt solution product containing at least one epoxide. The embodiments of the apparatuses and method of the present invention are especially suited to aiding in and improving the formation of the olefin chlorohydrin.

The olefin chlorohydrin is, in this respect, preferably formed by contacting a low chlorides aqueous hypochlorous acid (HOCl) solution with at least one unsaturated organic compound to form an aqueous organic product comprising at least one olefin chlorohydrin. The "unsaturated organic compound" may contain from 2 to about 10 carbon atoms, preferably 2 to 8 carbons, and more preferably 2 to 6 carbons. The organic compound is selected from a group consisting of substituted and unsubstituted olefins and may be linear, branched, or cyclic, preferably linear. Suitable olefins include amylenes, allene, butadiene, isoprene, allyl alcohol, cinnamyl alcohol, acrolein, mesityl oxide, allyl acetate, allyl ethers, vinyl chloride, allyl bromide, methallyl chloride, propylene, butylene, ethylene, styrene, hexene and allyl chloride and their homologues and analogs. Propylene, butylene, ethylene, styrene, hexene and allyl chloride are the preferred olefins; with propylene, butylene, and allyl chloride more preferred and propylene most preferred. The olefin is preferably unsubstituted, but may also be inertly substituted. By "inertly" it is meant that the olefin is substituted with any group which does not undesirably interfere with formation of the chlorohydrin or the epoxide. Inert substituents include chlorine, fluorine, phenyl, and the like. Additional descriptions of an epoxidation process and an associated chlorohydrin forming step of the type summarized herein may be found in commonly-assigned U.S. Pat. Nos. 5,486,627 and 5,532,389 (which are incorporated herein by reference).

As demonstrated above, embodiments of the invention provide an apparatus for mixing fluids, the apparatus including a hollow mixing body, a first conduit passing through the mixing body with at least one tapered jet hole, and a second conduit operatively connected to the mixing body. The apparatus eliminates or reduces plugging in the mixing device which improves mixing efficiency.

While the invention has been described with respect to a limited number of embodiments, the specific features of one embodiment should not be attributed to other embodiments of the invention. No single embodiment is representative of all aspects of the inventions. Variations and modifications from the described embodiments exist. The method of mixing the fluids is described as comprising a number of acts or steps. These steps or acts may be practiced in any sequence or order unless otherwise indicated. Embodiments of the invention have one or more of the following advantages. First, some mixers described herein are easily incorporated into existing processing units. Second, some of the mixing devices increase the flow through the device without increasing the pressure drop across the device. But no single embodiment should be construed to require all of these advantages. Finally, any number disclosed herein should be construed to mean approximate, regardless of whether the word "about" or "approximately" is used in describing the number. The appended claims intend to cover all those modifications and variations as falling within the scope of the invention.

We claim:

1. A shear mixing apparatus, comprising:

a fluid receiving chamber, at least one first conduit having an outer surface and an inner surface passing through the fluid receiving chamber and having at least one tapered aperture therethrough, the at least one tapered aperture extending from a first opening defined in the outer surface of the at least one first conduit to a second opening defined in the inner surface of the at least one first conduit, and a second conduit operatively connected to the fluid receiving chamber, wherein the at least one tapered aperture has an axis perpendicular to the first conduit, and wherein the at least one tapered aperture tapers continuously as it extends from the first opening toward the second opening.

2. The apparatus of claim 1, further comprising a secondary barrier having orifices therethrough and wherein the secondary barrier surrounds the first conduit.

3. The apparatus of claim 2, wherein the orifices of the secondary barrier have a smaller diameter than the diameter of the tapered apertures at the outer surface of the first conduit.

4. The apparatus of claim 2, wherein the secondary barrier comprises a pipe.

5. The apparatus of claim 1, wherein a plurality of first conduits pass through the fluid receiving chamber, each conduit having at least one tapered aperture therethrough and wherein each of the first conduits is operatively connected to the fluid receiving chamber.

6. The apparatus of claim 1, wherein the taper of the apertures has at least one angle ranging from greater than 0 degrees to less than 90 degrees.

7. The apparatus of claim 6, wherein the taper of the apertures has at least one angle ranging from about 5 degrees to less than 60 degrees.

8. The apparatus of claim 7, wherein the taper of the apertures has at least one angle ranging from greater than 10 degrees to less than 30 degrees.

9. The apparatus of claim 8, wherein the taper of the apertures has at least one angle ranging from greater than 10 degrees to less than 15 degrees.

10. The apparatus of claim 6, wherein the angle is determined with respect to a plane perpendicular to the surface of the first conduit.

11. The apparatus of claim 6, wherein the angle is determined with respect to the central axis of the aperture.

12. The apparatus of claim 1, wherein the aperture has a single taper angle.

13. The apparatus of claim 1, wherein the aperture has two or more taper angles.

14. The apparatus of claim 1, wherein an axis of the aperture forms an angle ranging from greater than 0 degrees to less than 90 degrees with respect to a surface of the first conduit.

15. The apparatus of claim 1, wherein the first conduit comprises a plurality of tapered apertures therethrough.

16. The apparatus of claim 1, wherein the first conduit comprises a plurality of tapered apertures and the aperture contained in a plane having a thickness equal to the largest dimension of the aperture openings.

17. The apparatus of claim 16, wherein the plane is perpendicular to the central axis of the first conduit.

18. The apparatus of claim 1, wherein the first conduit comprises multiple rows of tapered apertures.

19. A method of mixing, comprising:

passing a first liquid fluid through at least one first conduit having at least one tapered aperture therethrough, the at least one tapered aperture extending from a first opening defined in the outer surface of the at least one first conduit to a second opening defined in the inner surface of the at least one first conduit, passing a second liquid fluid into the first conduit through the at least one tapered aperture; and allowing the first and second liquid fluids to mix in the first conduit, wherein the at least one tapered aperture has an axis perpendicular to the first conduit, and wherein the at least one tapered aperture tapers continuously as it extends from the first opening toward the second opening.

* * * * *